United States Patent [19]

Bachmann

[11] Patent Number: 4,570,682

[45] Date of Patent: Feb. 18, 1986

[54] SYSTEM FOR CONDITIONING TEXTILE MATERIAL IN A WEAVING MACHINE

[75] Inventor: Urs Bachmann, Winterthur, Switzerland

[73] Assignee: Sulzer Brothers Limited, Winterthur, Switzerland

[21] Appl. No.: 632,238

[22] Filed: Jul. 19, 1984

[30] Foreign Application Priority Data

Aug. 30, 1983 [CH] Switzerland ..... 4749/83

[51] Int. Cl.[4] ..... D03J 1/02

[52] U.S. Cl. ..... 139/1 C

[58] Field of Search ..... 139/1 R, 1 C; 15/306 A, 15/405; 57/304

[56] References Cited

U.S. PATENT DOCUMENTS

| | | | |
|---|---|---|---|
| 2,400,792 | 5/1946 | Turner | 139/1 C |
| 4,265,278 | 5/1981 | Jassniker | 139/1 C |
| 4,397,339 | 8/1983 | Muller | 139/1 C |

FOREIGN PATENT DOCUMENTS

| | | | |
|---|---|---|---|
| 2027878 | 2/1980 | United Kingdom | 139/1 C |

*Primary Examiner*—Henry S. Jaudon

*Attorney, Agent, or Firm*—Kenyon & Kenyon

[57] ABSTRACT

The weaving machine is provided with an air conditioning system which delivers air upwardly from the floor between the heddles and cloth beam. The conditioning system uses a covering over the air outlets which has a plurality of outlet openings for passing a plurality of thin and gentle jets of air into the space between the heddles and cloth beam. The fine outlet openings are sized with dimensions less than 1 millimeter.

9 Claims, 5 Drawing Figures

SYSTEM FOR CONDITIONING TEXTILE MATERIAL IN A WEAVING MACHINE

This invention relates to a system for conditioning textile material in a weaving machine.

Heretofore, various types of systems have been known for conditioning textile material in a weaving machine. For example, Swiss Pat. No. 524,702 describes a system in which a feed duct for air which is processed in a central unit extends under a weaving machine in a longitudinal direction as well as at least one upwardly directed air outlet from the duct for directing air upwardly into the weaving machine. Similar systems where processed air is supplied to selected areas of a weaving machine through conduits, ducts or hoses are also described in U.S. Pat. No. 2,421,135, French Pat. Nos. 1,486,241 and 1,555,427 as well as Swiss Pat. No. 490,549. Since air conditioning is necessary mainly on the warp beam side of the heddles, that is primarily for the removal of generated heat and a moistening of the warp material, the known air conditioning systems have had the feed ducts arranged between the heddles and the warp beam.

As is known, air conditioning systems which employ distributing pipes and ducts and hoses require high investment costs and are often undesirable for reasons of space or cannot be accomodated at all.

While it may be possible to simply eject air into a space under a weaving machine, such involves difficulties. For one thing, this requires a uniform distribution of the ejected air over the length of the machine. That is, over all air outlets within the weaving machine. Secondly, dust and fiber material which collect under the machine, especially in the area between the warp beam and the heddles, must not be whirled up again and be entrained by the injected air due to an ejection effect of air jets.

Accordingly, it is object of the invention to provide an air conditioning system for the textile material of a weaving machine which is of simple construction.

It is another object of the invention to be able to supply conditioned air to the underside of a weaving machine in a simple economical manner.

It is another of the invention to reduce the number of parts required for distributing conditioned air within a weaving machine.

It is another object of the invention to provide an air conditioning system for a weaving machine can be readily accessed for cleaning and maintenance.

Briefly, the invention provides a system for conditioning material in a weaving machine having a plurality of heddles and a cloth beam wherein the system is positioned between the heddles and cloth beam. In this respect, the system includes a feed duct which extends under the textile machine and which has an air outlet extending towards a space between the heddles and the cloth beam. In addition, the system has a covering over the air outlet of the feed duct which has a plurality of fine outlet openings therein.

In use, the air conditioning system directs a plurality of thin and gentle jets of air freely into the space between the heddles and cloth beam.

Of note, much less dust and fiber material collects between the heddles and the cloth beam than on the warp beam side of the heddles. Moreover, many weaving machines are equipped with dust collecting plates which deflect settling dirt toward the warp beam side in order protect the heddle drive against dust and fiber material.

A uniform distribution of conditioning air can be obtained over the whole length of the air outlet, or outlets where more than one is provided, forceably by the build up of a pressure zone in the feed duct or in the air outlet or outlets in the covering. In this regard, a relatively high pressure gradient, for example, of 50–500 Pa is maintained in the covering of the air outlet. Through the fine outlet openings, the aperture diameter of which is advantageously less than one millimeter, for example, under 0.5 millimeter, the air is divided into individual jets which are so fine and "gentle" that they do not entrain and whirl up again by injection any fibers that might deposit in the area of the covering.

The necessary pressure drop is dependent upon the velocities prevailing in the feed duct, which velocities are approximately 2 to 12 meters per second. The correlation between air velocity and pressure drop is in direct ratio, i.e., high velocities require greater pressure drop. The size and number of the outlet openings, in turn, are correlated with the necessary pressure drop, a high pressure drop requiring small aperture dimensions and a relatively small number of openings.

An additional advantage of the arrangement of the air outlet between the heddles and the cloth beam side of the weaving machine resides in that the air outlet is accessable more often for cleaning or maintenance since the cloth beam is changed more frequently than a warp beam.

The covering in which the air outlets are formed may be of any suitable material, for example a textile fabric and, particularly, a commercially available monofil screen fabric of polyamide in which the side length of a mesh opening is less than 0.5 millimeters.

The distribution of the conditioning air into the space below the weaving machine can be improved if the covering extends into the space between the heddles and warp beam with a convex camber, at least with a positive pressure in the feed duct.

In addition, for weaving machines having dust collecting plates in the area of the heddles, it is expedient if the air outlet is directed into a back pressure zone between the plate and a floor supporting the weaving machine and if a plurality of openings are provided in the plate for passage of air from the back pressure zone.

A flexible apron may also be used on the weaving machine to separate the cloth beam from the space in which the back pressure zone is formed.

These and other objects and advantages of the invention will become more apparent from the following detailed description taken in conjunction with the accompanying drawings, wherein.

Figure 2:
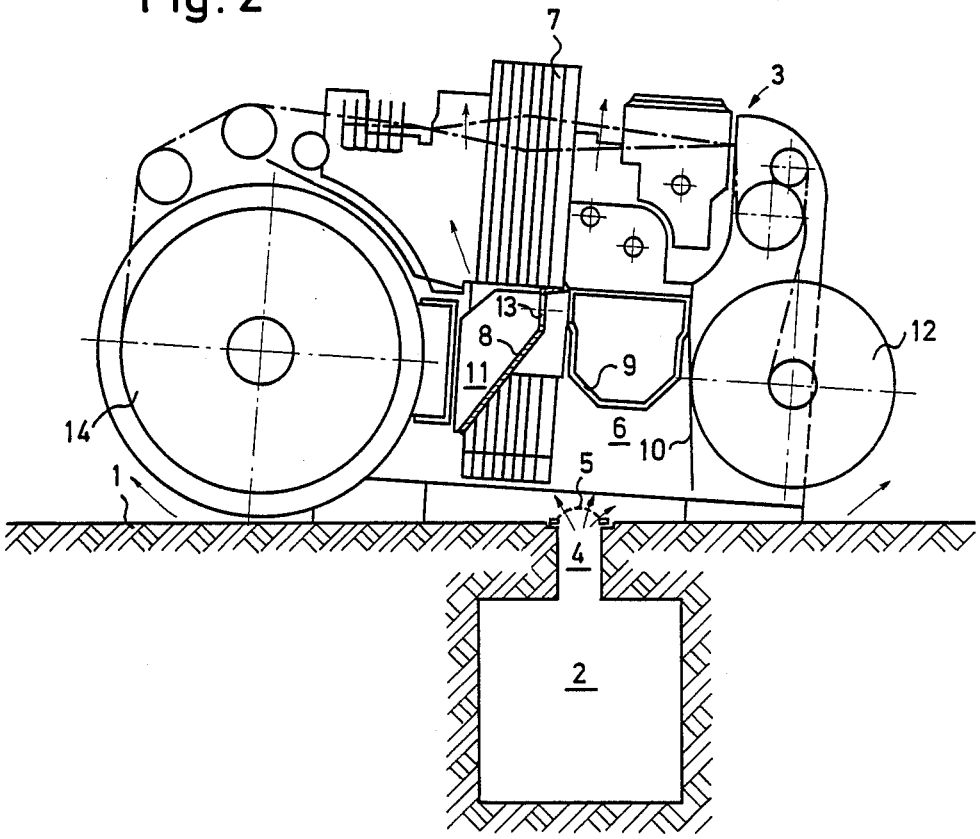
FIG. 2 illustrates a view taken on line II—II of FIG. 1.

Referring to FIG. 2, a weaving machine 3 is mounted on a floor 1 such as a concrete floor 1 of a plant, for example with accompanying rows of weaving machines (not shown). In addition, a system for conditioning the textile material in a weaving machine 3 is provided in the floor 1 of the plant for supplying conditioned air to one or more of the weaving machines.

Figure 1:
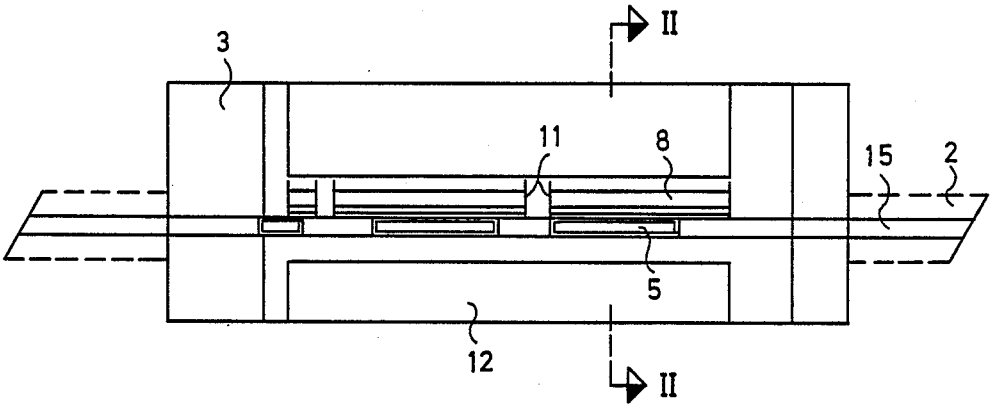
FIG. 1 illustrates a schematic top view of a weaving machine employing an air conditioning system in accordance with the invention.

Referring to FIGS. 1 and 2, the conditioning system includes a feed duct 2 which extends under the weaving machine, for example longitudinally as viewed in FIG. 1, so as to be common to a plurality of weaving machines of a series which are lined up in a lengthwise direction. As such, the feed duct 2 may extend through the entire machine hall or plant without interruption.

Of note, the feed ducts 2, of which only one is shown, are provided with a supply of processed air from a central unit (not shown).

As indicated, each feed duct 2 has one or more air outlets 4 which extend upwardly in the floor 1 in the area of each weaving machine. In addition the air outlets 4 are closed off by three air-permeable coverings which are flush with the floor 1 with the space between the coverings 5 closed off by cover plates 15 (see FIG. 1).

As shown in FIG. 2, each weaving machine 3 has a plurality of heddles 7, a warp beam 14 for supplying warp yarns to the heddles 7 for formation of a shed and a cloth beam 12 on the opposite side of the heddles 7 from the warp beam 14. The air outlets 4 of the feed duct 2 extend towards a space 6 between the heddles 7 and the cloth beam 12 in order to deliver conditioned air into this space.

As further shown in FIG. 2, the weaving machine 3 has a plurality of dust collecting plates 8 below the heddles 7 for collecting and deflecting dust and dirt. In addition, lateral end plates 11 are disposed at the ends of the deflecting plates 8. As indicated in FIG. 1, the plates 11 are aligned with the cover plates 15 over the air outlet 4. In addition, the space 6 is limited on the upper side by a central support 9 of the weaving machine as well as by a flexible apron 10 which separates the cloth beam 12 from the space 6. This apron may be formed, for example, of a plastic foil. The space 6 thus forms a back pressure zone for the air which is injected through the covering 5.

Figure 5:
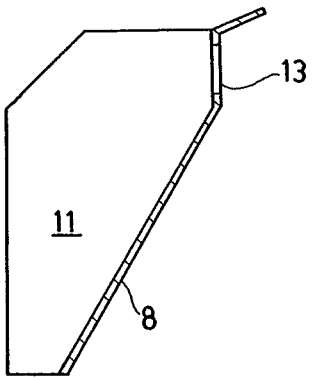
FIG. 5 illustrates a view taken on line V—V of FIG. 4.
Figure 4:
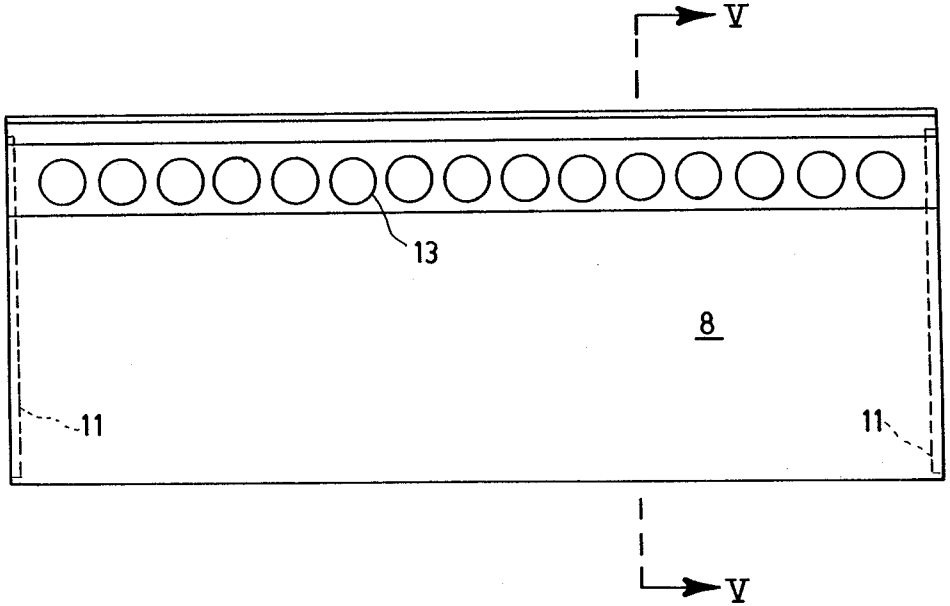
FIG. 4 illustrates a front view of a dust collecting plate constructed in accordance with the invention.

As shown in FIGS. 4 and 5, a plurality of openings 13 are provided in each dust collecting plate 8 in order to ensure that the air injected under the plates 8 can flow not only to the warp beam 14 by passing below the plates but also into the area on the warp beam side of the heddles 7 at a higher position.

Figure 3:
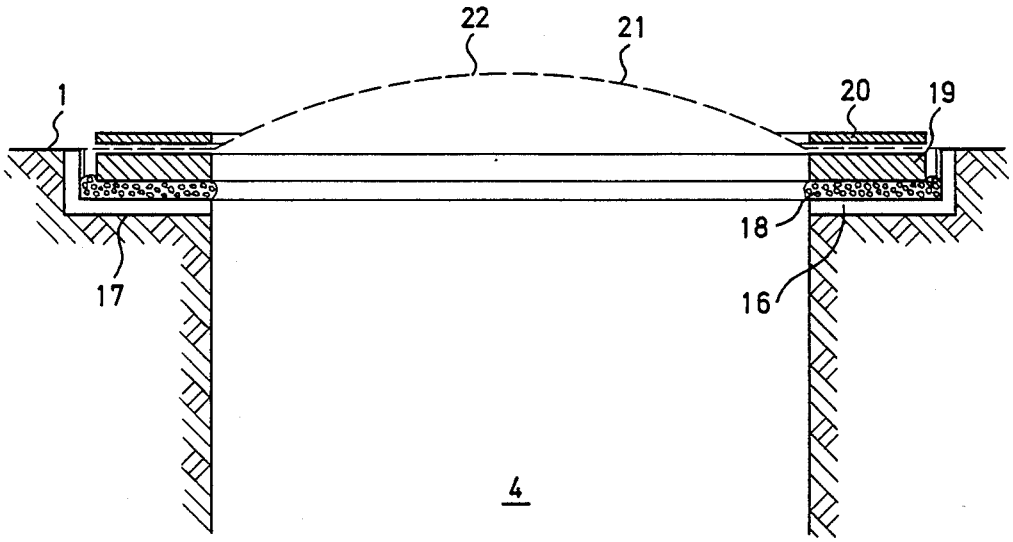
FIG. 3 illustrates an enlarged detail view of FIG. 2 of the covering over an air outlet of the air conditioning system.

Referring to FIG. 3, wherein like reference characters indicate like parts as above, the floor 1 is provided with a step 17 which enlarges the width of the air outlet 4 at floor level. In addition, a sill 16 formed by an angle iron is provided in the step 17 and is anchored to the concrete floor 1. The covering 5 is disposed on the sill 16 via seal elements 18. In this regard, the covering 5 is formed of a base frame 19, a fastening frame 20 and a screen fabric 21 which is clamped to the base frame 19 by means of the fastening frame 20 in suitable manner.

The width of the web of the screen fabric 21 is selected relative to the width of the frames 19, 20 so that under a positive pressure in the air outlet 4, the fabric 21 bulges out with a convex camber. This serves to improve the distribution of ejected air to the left and right as viewed.

The screen fabric 21 which may be alternatively replaced by some other element such as an arched plate with fine pores, forms a plurality of fine outlet openings 22 through which air issues into the space 6 in thin and "gentle" jets.

In a test plant, the screen fabric 21 was constructed of a commercial screen fabric and was of polyamide.

Referring to FIG. 2, in use, conditioned air at a feed pressure in the feed duct 2 is delivered upwardly through the respective air outlets 4 and passed through the coverings 5 into the space 6 on the underside of the weaving machine 3. Upon passing through the coverings 5, the air is divided into thin, fine and gentle jets which are characterized in that dust and fiber material which may have collected in the area of the coverings 5 do not become entrained and whirled up again by injection into the interior of the weaving machine.

The invention thus provides an air conditioning system which does not require high investment costs and which can be deployed within a minimum of space. Further, the invention provides an air conditioning system which is able to deliver conditioned air into a weaving machine in a simple economical manner without stiring up dust and dirt which may have settled in the area of the outlet openings for the air into the weaving machine.

The invention further avoids the need for additional transporting pipes, ducts or hoses inside the weaving machine.

What is claimed is:

1. A system for conditioning textile material in a weaving machine having a plurality of heddles and a cloth beam, said system including a feed duct extending under a weaving machine and having an air outlet extending towards a space between the heddles and cloth beam, and a covering over said air outlet having a plurality of fine outlet openings therein.

2. A system as set forth in claim 1 wherein each said outlet opening has a diameter of at most one millimeter.

3. A system as set forth in claim 2 wherein said covering is a textile fabric.

4. A system as set forth in claim 1 wherein each said outlet opening has a diameter of at most 0.5 millimeters.

5. A system as set forth in claim 1 wherein said covering extends into said space with a convex camber at least with a positive pressure in said feed duct.

6. In combination, a weaving machine having a plurality of heddles and a cloth beam;

a feed duct extending under said weaving machine for conducting a flow of conditioned air therethrough and having an air outlet extending into a space between said heddles and said cloth beam; and a covering over said air outlet having a plurality of outlet openings therein for passing a plurality of thin and gentle jets of air into said space.

7. The combination as set forth in claim 6 wherein said outlet openings have a diameter of at most one millimeter.

8. The combination as set forth in claim 6 wherein said weaving machine includes a dust collecting plate for collecting dust in the area of said heddles and for defining a backpressure zone between said plate and a floor supporting said machine in communication with said air outlet, and a plurality of openings in said plate for passage of air from said zone therethrough.

9. The combination as set forth in claim 6 which further comprises a flexible apron separating said cloth beam from said space.

* * * * *